US006619782B2

(12) United States Patent
Shigeno

(10) Patent No.: US 6,619,782 B2
(45) Date of Patent: Sep. 16, 2003

(54) INK JET RECORDING APPARATUS AND OPERATION METHOD THEREOF

(75) Inventor: Kenji Shigeno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/056,029

(22) Filed: Jan. 28, 2002

(65) Prior Publication Data

US 2002/0109748 A1 Aug. 15, 2002

(30) Foreign Application Priority Data

Jan. 31, 2001 (JP) ..... 2001-023766

(51) Int. Cl.[7] ..... B41J 2/165
(52) U.S. Cl. ..... 347/33
(58) Field of Search ..... 347/33, 22, 31, 347/32, 34

(56) References Cited

U.S. PATENT DOCUMENTS 5,984,452 A * 11/1999 Bekki ..... 347/33
6,189,999 B1 * 2/2001 Pham et al. ..... 347/33

FOREIGN PATENT DOCUMENTS

EP 0 841 168 A2 * 5/1998
JP 11-342637 12/1999
JP 2000-15844 1/2000
JP 2000-110874 4/2000
JP 2000-127450 5/2000

OTHER PUBLICATIONS

U.S. application No. 09/983,843, filed Oct. 26, 2001, Allowed, pat. No. pending.

* cited by examiner

*Primary Examiner*—Shih-wen Hsieh
(74) *Attorney, Agent, or Firm*—Fitzpatrick, Cella, Harper & Scinto

(57) ABSTRACT

An ink jet recording apparatus comprises a carriage having mounted thereon a recording device provided with discharge port surface with discharge ports for discharging ink to a recording material, a wiper blade for wiping and cleaning the discharge port surface of the recording device, and a blade cleaner for wiping off ink adhering to the wiper blade. For this ink jet recording apparatus, the side face portion of the carriage blocks or reduces ink spreading to the recording material conveyance area when wiper blade moves out from the blade cleaner. With the structure thus arranged, this ink jet recording apparatus can prevent ink adhering to the wiper blade from spreading to the recording material conveyance area by resilient restoring force of the wiper blade when the wiper blade moves out from the blade cleaner, hence preventing a recording material from being stained by spreading ink.

9 Claims, 14 Drawing Sheets

INK JET RECORDING APPARATUS AND OPERATION METHOD THEREOF

BACKGROUND OF THE INVENTION

1. Field of the Invention

The present invention relates to an ink jet recording apparatus for recording by discharging ink from recording means for a recording material, and also, relates to the operation method thereof.

2. Related Background Art

Conventionally, there has been proposed recording by use of recording means (recording head, printing head) of a recording apparatus (a printing apparatus, or the like) of various types, such as wire-dot type, thermo-sensitive type, thermal transfer type, or ink jet type, for recording (printing or the like) on a recording material (also referred to as a recording medium, a printing medium, or simply as a recording sheet) such as paper, cloth, plastic sheet, OHP sheet, or the like.

Of these recording apparatuses, the recording apparatus of ink jet type (hereinafter may also be referred to as an ink jet apparatus) for discharging ink from the discharge ports to record on a recording material (recording sheet) is of low-noise non-impact recording type, which makes it possible to perform a recording operation in high density at high speed. The widely used serial type ink jet recording apparatus is provided with carriage driving means for driving the carriage that mounts the recording head (recording means); conveying means for conveying (sheet feeding) a recording material (recording sheet) by use of the recording unit; and control means for controlling them.

On the other hand, as the energy generating element that generates energy to be utilized for discharging ink from the discharge ports of a recording head (recording means), there is the one that uses electromechanical converting member such as piezoelectric element, irradiates electro-magnetic waves, such as laser, to generate heating for discharging ink droplets by the action of such heating, or uses electrothermal converting element provided with heat generating resistive element to heat liquid, among some others. The recording head of ink jet recording method that discharges ink as droplets by utilization of thermal energy, in particular, makes it possible to record in high resolution, because the discharge ports can be arranged in high density. Particularly, it is favorable to adopt the head that uses electrothermal converting element as the energy generating element, which can be made smaller with ease and manufactured with the full utilization of the advantages of the IC technologies and micro-machining techniques, the advancement and reliability of which are remarkably enhanced in the semiconductor field in recent years, leading to the easier assembling in higher density at lower manufacturing costs.

As described above, the ink jet recording method is simply structured and an exceptionally fine recording method. On the other hand, however, it still has technical problems to be solved. The ink jet recording apparatus performs recording by discharging ink from fine discharge ports to a recording material. As a result, unwanted ink droplets tend to adhere to the discharge port surface. Such ink adhesion may sometimes impede exact ink discharges. To counteract this, the conventional ink jet recording apparatus is provided with wiping means for wiping the discharge port surface for cleaning. Then, a structure is adopted to remove the ink adhesion around the discharge ports by means of relative movements of wiping means and recording means.

As the wiping method, there is the case where the recording head scans (moves) against the stationary wiper blade or the case where while the recording head is stationary, the wiper blade moves in parallel or moves rotationally. When the recording head moves, most of the cases are such as to utilize the main scanning for recording. In such a case, the blade is arranged to enter into or retract from between the positions of the blade being overlapped with and retracted from the traveling path of the recording head. In this way, the wiping is conducted only when it is needed. Also, when the wiper blade moves, it is arranged to enable the blade to move in parallel to the direction orthogonal to the main scanning direction for recording or to reciprocally move by rotation. In this case, with the recording head being allowed to enter or exit from the position of the wiper blade, the wiping can be performed only when it is needed. In other words, when the wiping is performed by reciprocation, the recording head is arranged to retract when the backward (returning) operation is executed, it is made possible to prevent the wiper blade and the recording head from being in contact more than necessary.

Further, to maintain the performance of the aforesaid wiper blade, there is a need for removing ink that has adhered to the wiper blade. Consequently, the wiper blade is allowed to be in contact with an ink absorbent to absorb ink or to abut against a mold or a metallic edge to scrape off ink. When the wiping is performed by means of the main scanning of the recording head, a blade cleaner (a member to clean the wiper blade) is provided for the recording head or a carriage that mounts the recording head. Also, when the wiper blade moves for the execution of wiping, the cleaning member (blade cleaner) is arranged in a position in which the wiper blade is in contact with the recording head immediately after wiping.

However, when the wiper blade advances to or retracts from the blade cleaner, the wiper blade is once bent, and then, restored. Therefore, a drawback is encountered that the remaining ink that has adhered to the wiper blade spreads to stain the interior of the recording apparatus. For the recovery device the driving source of which operates the recovery device for maintaining the recording head, and also, should operate a plurality of recovery means in particular, may sometimes execute a pseudo operation in the same manner as the wiping operation when performing a mechanical operation needed for operating recovery means or recovery device other than the wiping operation. Then, in such a case, the wiper blade is caused to bend in the direction in which the remaining ink (ink adhesion) on the wiper blade spreads with respect to the recording sheet conveyance area as the wiper blade retracts after it has entered the blade cleaner. Consequently, the recording sheet conveyance area may be stained more often by ink thus spread.

SUMMARY OF THE INVENTION

It is an object of the present invention to provide an ink jet recording apparatus capable of preventing ink adhering to a wiper blade from spreading to the recording material conveyance area by resilient restoring force of the wiper blade when the wiper blade moves out from a blade cleaner, hence preventing a recording material from being stained by spreading ink, and also, to provide a method of operation thereof.

It is another object of the invention to provide an ink jet recording apparatus comprising a carriage having mounted thereon recording means provided with discharge port surface with discharge ports for discharging ink to a recording material; a wiper blade for wiping and cleaning the discharge port surface of the recording means; and a blade cleaner for wiping off ink adhering to the wiper blade. For this ink jet recording apparatus, the side face portion of the carriage blocks or reduces the spreading of ink to the recording material conveyance area when the wiper blade moves out from the blade cleaner.

It is still another object of the invention to provide a method of operation for an ink jet recording apparatus provided with a carriage having mounted thereon recording means with discharge port surface having discharge ports for discharging ink to a recording material; a wiper blade for wiping and cleaning the discharge port surface of the recording means; and a blade cleaner for wiping off ink adhering to the wiper blade, comprising the steps of wiping off ink adhering to the wiper blade by the blade cleaner; and enabling the carriage to reside in a position above the recording material conveyance area near the wiper blade and the blade cleaner when the wiper blade moves out from the blade cleaner.

In accordance with the present invention, it is possible to provide an ink jet recording apparatus capable of preventing ink adhering to a wiper blade from spreading to the recording material conveyance area by resilient restoring force of the wiper blade when the wiper blade moves out from a blade cleaner, hence preventing a recording material from being stained by spreading ink, and also, to provide a method of operation thereof.

DESCRIPTION OF THE PREFERRED EMBODIMENTS

Figure 1:
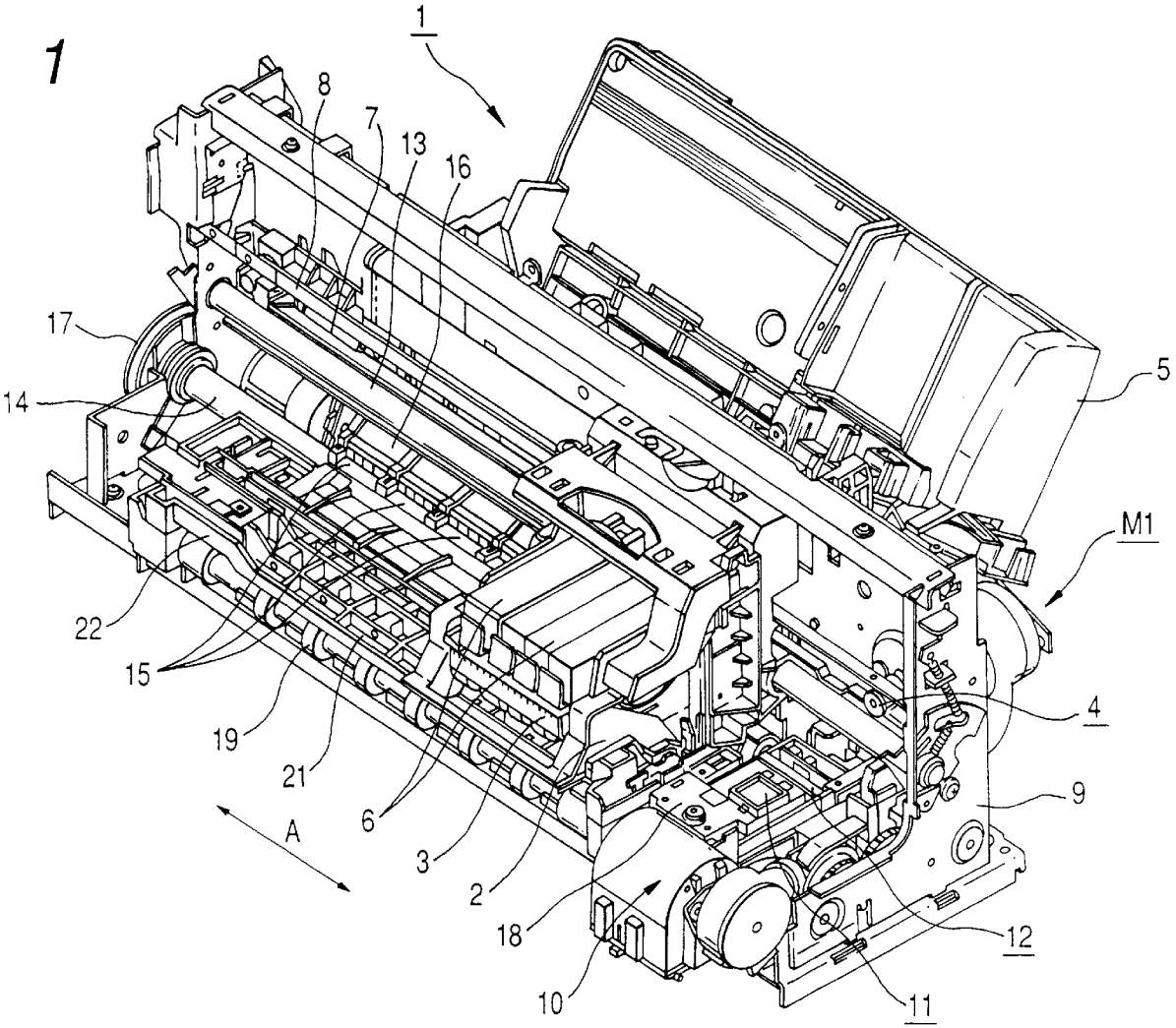
FIG. 1 is a perspective view that schematically shows the outline of the structure of one embodiment of the ink jet recording apparatus to which the present invention is applicable.
Figure 2:
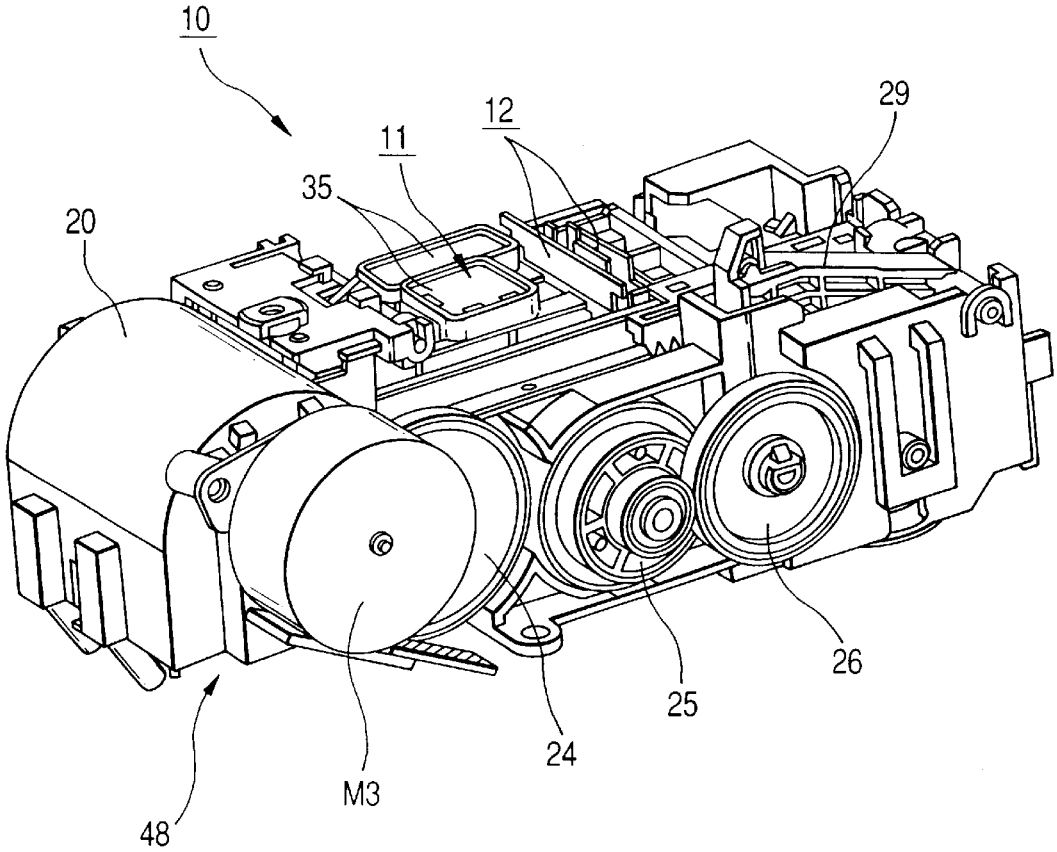
FIG. 2 is a perspective view that schematically shows one embodiment of the recovery device of the ink jet recording apparatus to which the present invention is applicable.
Figure 3:
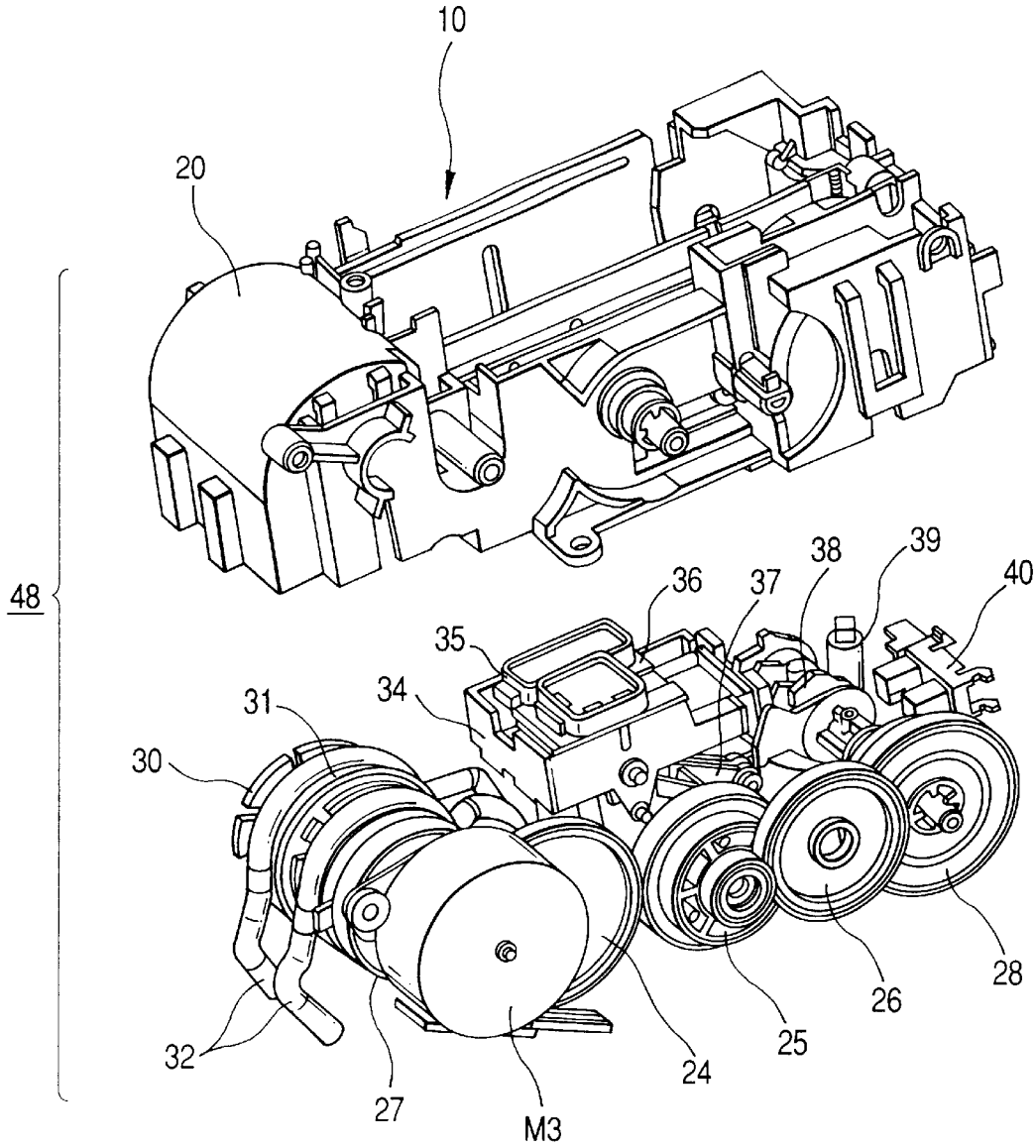
FIG. 3 is an exploded perspective view that schematically shows the inner structure of the recovery device represented in FIG. 2.
Figure 4:
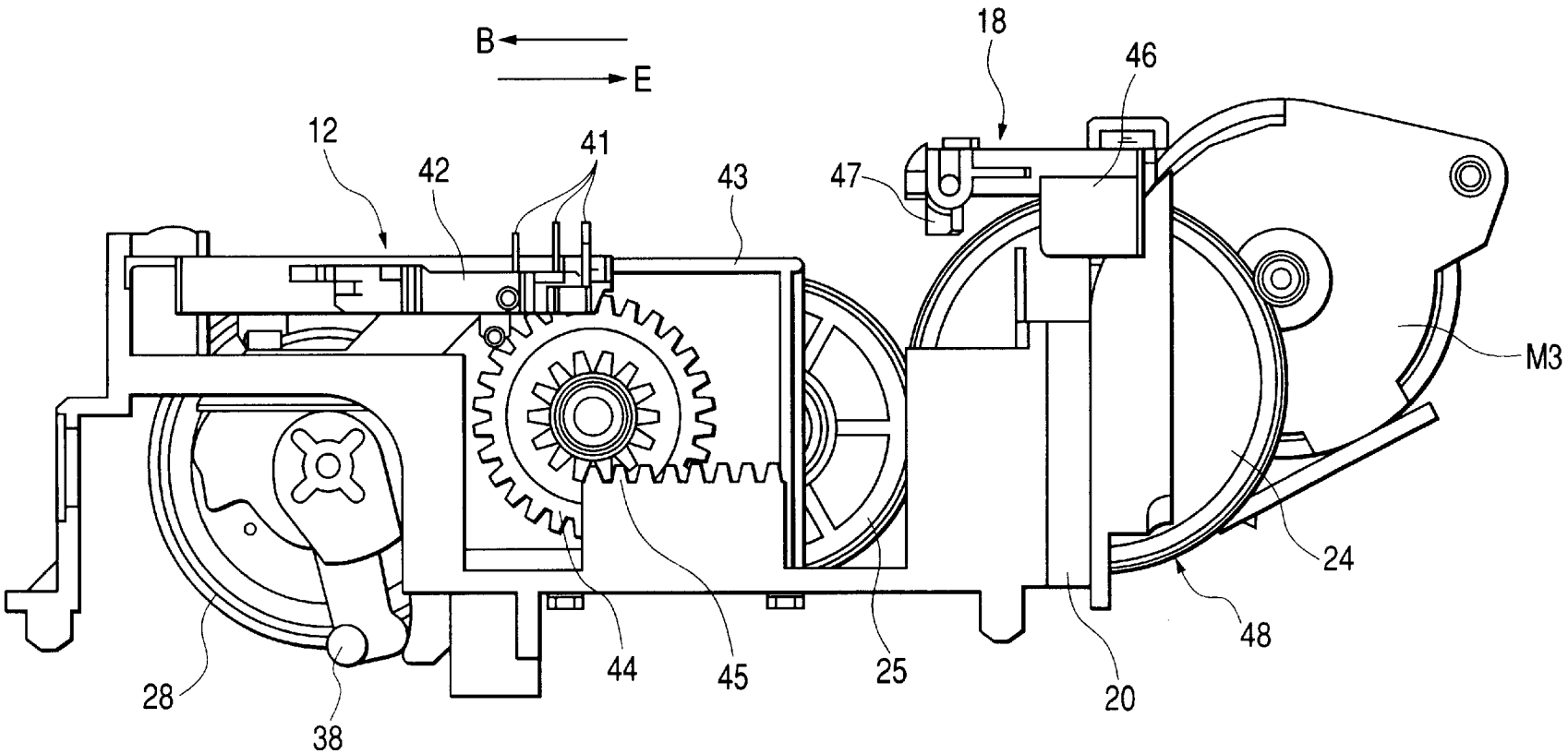
FIG. 4 is a side view that schematically shows the inner structure of one embodiment of the recovery device of the ink jet recording apparatus to which the present invention is applicable.

Hereinafter, with reference to the accompanying drawings, the specific description will be made of the embodiments in accordance with the present invention. Here, for each of the drawings, the same reference marks designate the same or corresponding parts. FIG. 1 is a perspective view that schematically shows the outline of the structure of one embodiment of the ink jet recording apparatus to which the present invention is applicable. FIG. 2 is a perspective view that schematically shows one embodiment of the recovery device of the ink jet recording apparatus to which the present invention is applicable. FIG. 3 is an exploded perspective view that schematically shows the inner structure of the recovery device represented in FIG. 2. FIG. 4 is a side view that schematically shows the inner structure of one embodiment of the recovery device of the ink jet recording apparatus to which the present invention is applicable.

In FIG. 1, the ink jet recording apparatus 1 comprises a driving motor M1 serving as the driving source; a carriage 2 that mounts the recording head (ink jet recording head) 3 serving as recording means; a transmission mechanism 4 to reciprocate the carriage (CR) 2 by use of the driving motor M1 in the direction indicated by arrows A; a sheet feed mechanism 5 for feeding and conveying a recording sheet serving as a recording material (recording medium); and a recovery device (recovery unit) 10 of the recording head 3 for executing the discharge recovery processing (recovery maintenance of ink discharge performance, and maintenance). For the ink jet recording apparatus 1 thus structured, a recording sheet is fed in by use of the sheet feed mechanism 5. Then, the recording head 3 makes a specific recording on the recording sheet. On the carriage 2, the recording head 3 and an ink cartridge 6 are detachably mounted (held).

To the recording head 3, ink contained in the ink cartridge 6 is supplied. In this case, it is arranged to enable the carriage 2 and the recording head 3 to be in contact exactly on the contact faces of both members in order to maintain the designated electrical contact. The recording head 3 is an ink jet recording head to selectively discharge ink from a plurality of discharge ports by the application of energy in accordance with recording signals. Also, the recording head 3 is ink jet recording means for discharging ink by the utilization of thermal energy, which is provided with electrothermal converting element that generates thermal energy. Further, the recording head 3 discharges ink from the discharge ports by the utilization of pressure changes to be made for recording by the growth and shrinkage of bubble created by film boiling caused by the thermal energy applied by the aforesaid electrothermal converting element. The aforesaid electrothermal converting element is provided for each of the discharge ports, respectively, to enable ink to be discharged from the corresponding discharge port by the application of pulse voltage to the corresponding electrothermal converting element in accordance with recording signals.

Figure 11:
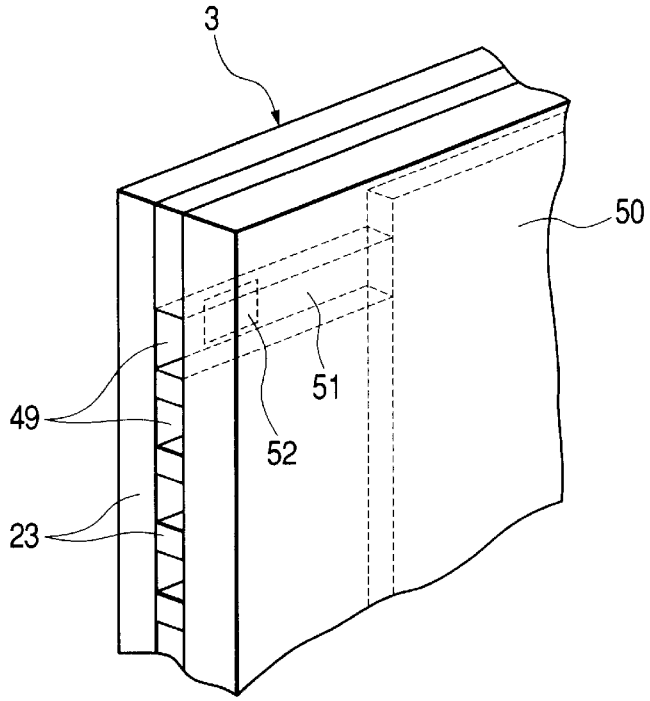
FIG. 11 is the schematically partial perspective view that shows the structure of an ink discharge unit of recording means represented in FIG. 1.

FIG. 11 is a partial perspective view that schematically shows the structure of the ink discharge unit (one discharge port array) of recording means (recording head) 3. In FIG. 11, plural discharge ports 49 are formed at designated pitches on the discharge port surface 23 that faces a recording material, such as a recording sheet, with a gap (approximately 0.3 mm to 2.0 mm, for example), and electrothermal converting element (such as heat generating resistive element) 52 for generating energy used for discharging ink is arranged along the wall face of each liquid path 51 that communicates the common liquid chamber 50 with each of the discharge ports 49. The recording head 3 is guided and supported with the positional relations which enable the discharge ports 49 to be in line in the direction intersecting with the main scanning movement direction (the traveling direction of the carriage 2, that is, directions indicated by arrows A in accordance with the present embodiment in which the recording head is mounted on the carriage 2). In this way, recording means (recording head) 3 is structured so as to enable the corresponding electrothermal converting element 52 to be driven (pulse voltage is applied thereto) in accordance with image signals or discharge signals, thus giving film boiling to ink in the liquid path 51 for discharging ink from the discharge port 49 by means of the pressure exerted at that time.

In FIG. 1, the carriage (CR) 2 is connected with a part of the driving belt 7 of the transmission mechanism 4 that transmits the driving power of the driving motor M1, and guided and supported slidably in the directions indicated by arrows A along the guide shaft 13, hence installing the carriage so as to be driven by the driving motor M1. Consequently, the carriage 2 reciprocates along the guide shaft 13 by means of the regular and reverse rotations of the driving motor M1. Also, for the apparatus main body, a scale 8 is provided to indicate the absolute positions of the carriage 2 in the directions indicated by arrows A. In accordance with the present embodiment, black bars are printed on a transparent PET film at required pitches to serve as the scale 8. One end of the scale is fixed to the chassis 9, and the other end is supported by a flat spring (not shown).

For the ink jet recording apparatus 1 shown in FIG. 1, a platen (not shown) is provided to face the discharge port surface 23 having the discharge ports 49 of the recording head 3 formed thereon, and recording is made on the entire width of a recording material, such as a recording sheet, which is conveyed on the platen, by discharging ink with recording signals given to the recording head 3, at the same time that the carriage (CR) 2 mounted on the recording head 3 is driven to reciprocate by means of the driving power of the driving motor M1. Here, a reference numeral 14 designates the conveying roller driven by the conveying motor M2 for conveying a recording paper (recording sheet) P; 15, a pinch roller that enables the recording sheet (recording material) to abut against the conveying roller 14 by use of a spring (not shown); and 16, a pinch roller holder that holds the pinch roller 15 rotatively.

Also, a reference numeral 17 designates a conveying roller gear fixed to one end of the conveying roller 14. With the rotation of the conveying motor M2 transmitted by use of this conveying roller gear 17, the conveying roll 14 is driven. An expelling roller 19 for expelling to the outside the recording sheet, on which the recording head 3 has formed images, is driven by the rotation of the conveying roller M2 transmitted to an expelling roller gear (not shown). Here, a reference numeral 21 designates a spur roller that enables the recording sheet P to be closely in contact with the aforesaid expelling roller 19 by use of a spring (not shown), and 22, a spur holder that rotatively supports the spur roller 21.

Also, in a desired position (position facing the home position, for example) outside the reciprocation range of carriage 2 having the recording head 3 for recording operation for the ink jet recording apparatus 1 (outside the recording area), a recovery device (recovery unit) 10 is arranged for maintaining the ink discharge performance of the recording head 3. The recovery device 10 comprises capping means 11 for capping the discharge port surface 23 of the recording head 3; wiping means 12 for wiping and cleaning the discharge port surface 23 of the recording head 3; and blade cleaning means 18 for cleaning the wiper blade of the wiping means. Then, in a state of the discharge port surface 23 being capped to air tightly close the discharge ports 49 by the aforesaid capping means 11, the suction means which is connected with capping means 11 is driven to execute the suction recovery process that forcefully sucks ink from the discharge ports 49 to be exhausted by driving suction means (a suction pump or the like). Suction means (a suction pump or the like) is also arranged in the recovery device (recovery unit) 10.

By the suction recovery process of the kind, overly viscous ink, bubble, or the like in the ink flow path of the recording head 3 is exhausted from the discharge port 49 for removal, thus performing the maintenance recovery of the ink discharge performance of the recording head 3. Also, when recording is at rest, the discharge port surface 23 of the recording head 3 is capped to protect the recording head, while preventing ink from being dried. Also, the aforesaid wiping means 12 wipes and removes ink droplets and paper particles adhering to the discharge port surface 23 of the recording head 3. This means is arranged in the vicinity of the aforesaid capping means 11.

When the discharge port surface 23 of the recording head 3 is wiped and cleaned (given wiping) by use of the wiper blade of wiping means 12, ink, paper particles, or the like is transferred to the wiper blade, and such transferred substance may be transferred again to the recording head 3 due to the repeated wiping. The retransfer of ink, paper particles, or the like to the recording head 3 must be prevented by all means, and it is required to refresh the wiper blade by scraping or wiping off ink or the like transferred to the wiper blade. Here, therefore, blade cleaning means 18 is provided for cleaning the wiper blade in order to scrape or wipe off the ink, paper particles, or the like that has been transferred to the wiper blade. Thus, it becomes possible to maintain the ink discharge performance of the recording head 3 in the normal condition at all times by use of capping means 11, wiping means 12, blade cleaning means 18, and the aforesaid suction means.

Figure 5:
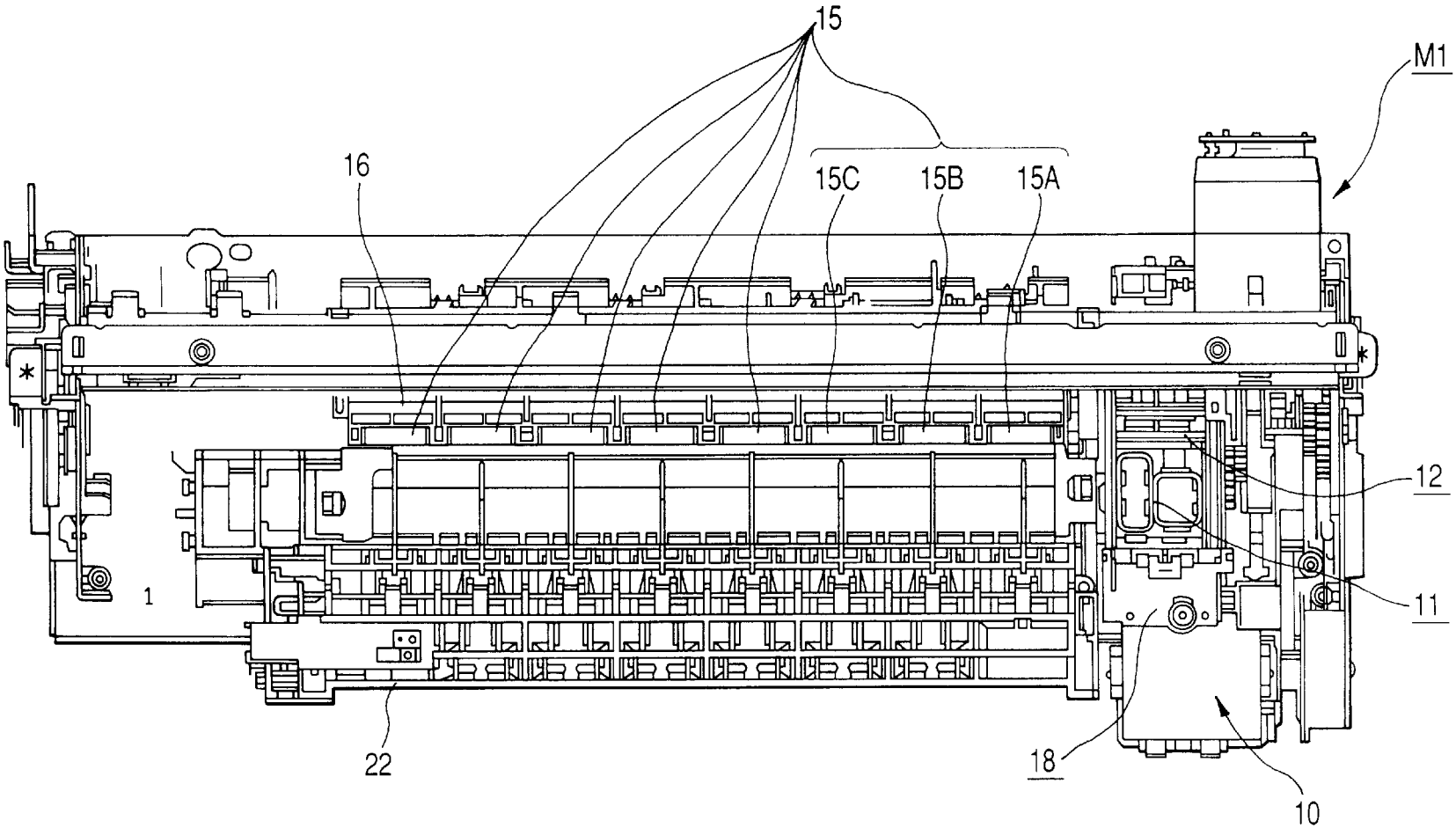
FIG. 5 is a plan view that schematically shows the inner structure of one embodiment of the ink jet recording apparatus to which the present invention is applicable.
Figure 6:
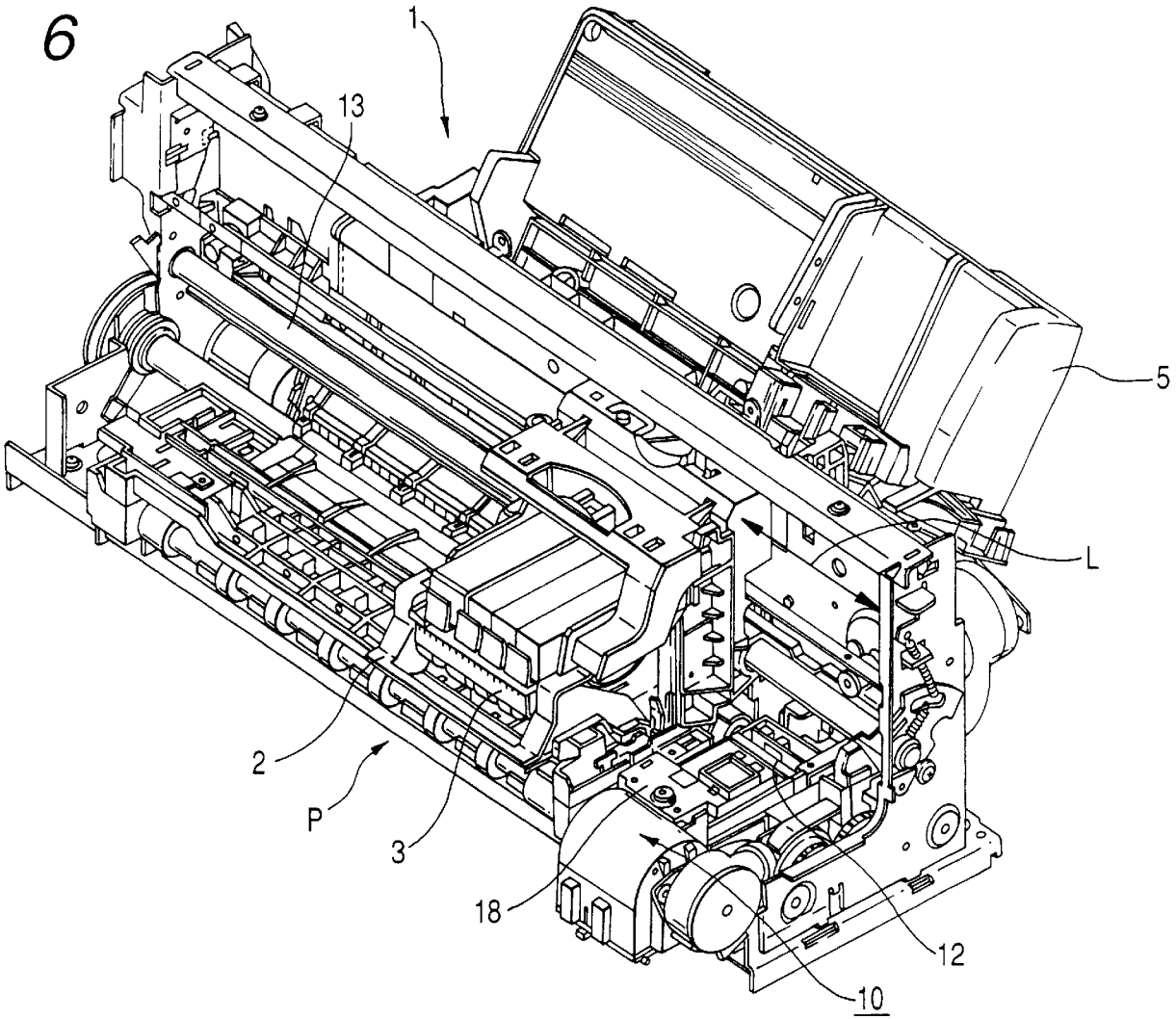
FIG. 6 is a perspective view that schematically shows the retracting position of a carriage and the position of a recovery device in accordance with one embodiment of the ink jet recording apparatus to which the present invention is applicable.
Figure 7:
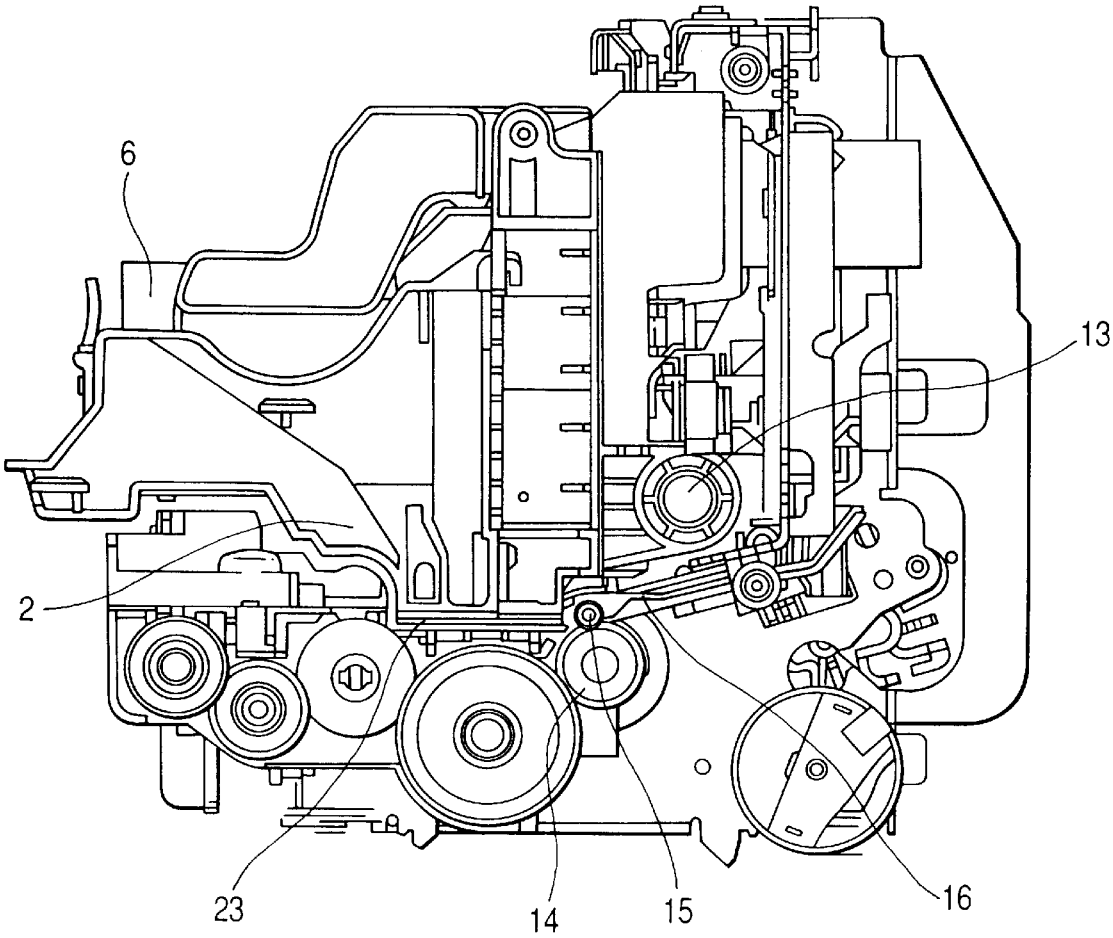
FIG. 7 is a side view that schematically shows the positional relations between a carriage and recording material conveying means in accordance with one embodiment of the ink jet recording apparatus to which the present invention is applicable.
Figure 8A:
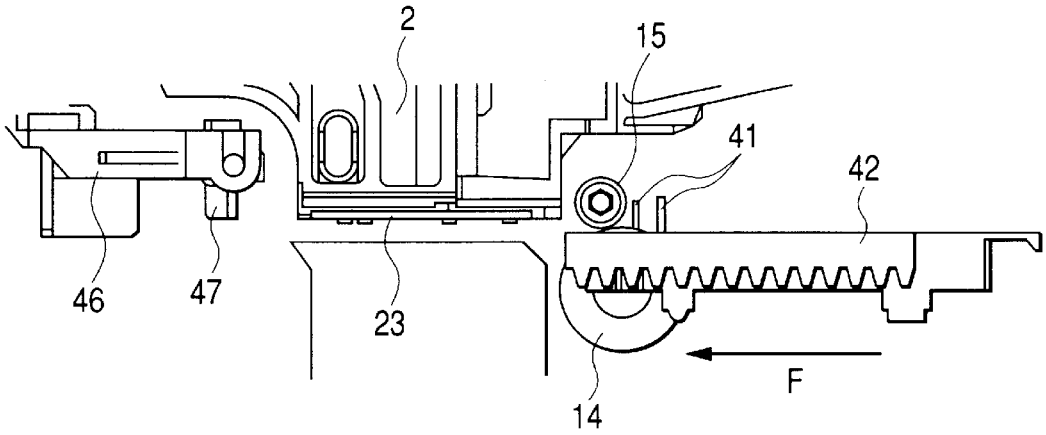
FIGS. 8A, 8B and 8C are views that schematically illustrate the wiping operation and the pseudo wiping operation of wiping means of the ink jet recording apparatus to which the present invention is applicable.
Figure 8B:
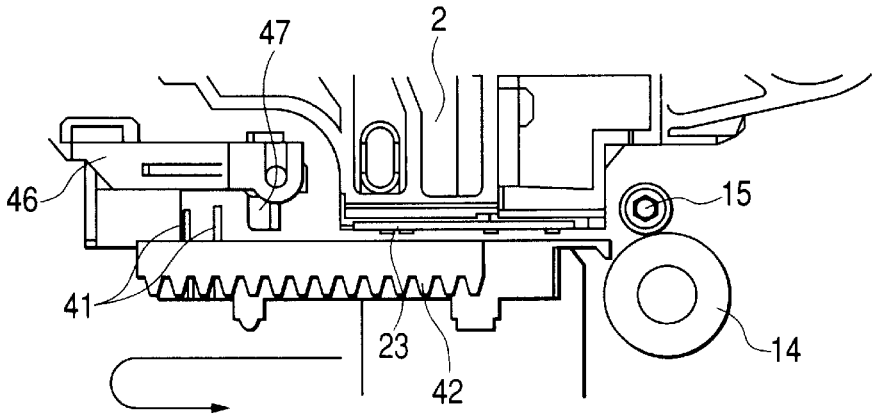
Figure 8C:
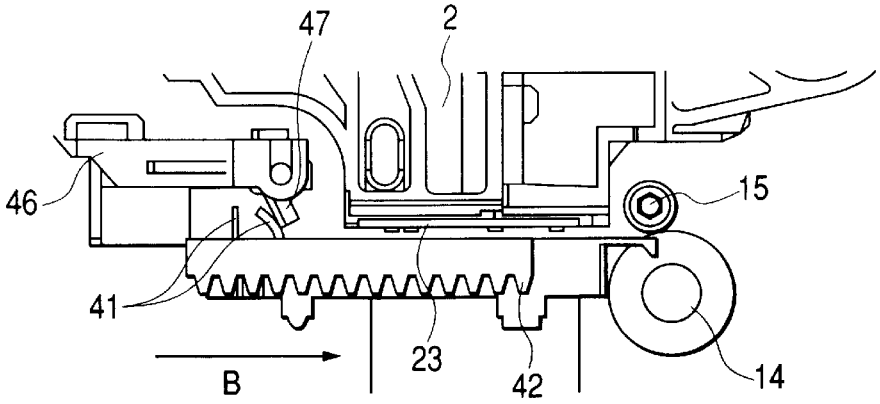

FIG. 2 is a perspective view that schematically shows capping means 11 and wiping means 12 of the recovery device (recovery unit) 10, observed from diagonally above; FIG. 3 is an exploded perspective view that schematically shows the inner structure of the recovery device 10 represented in FIG. 2.; FIG. 4 is a side view that schematically shows wiping means 12 and blade cleaning means 18 of the recovery device (recovery unit) 10; FIG. 5 is a plan view that schematically shows the inner structure of one embodiment of the ink jet recording apparatus to which the present invention is applicable; FIG. 6 is a perspective view that schematically shows the retracting position of a carriage and the position of a recovery device in accordance with one embodiment of the ink jet recording apparatus to which the present invention is applicable; FIG. 7 is a side view that schematically shows the positional relations between a carriage and recording material conveying means in accordance with one embodiment of the ink jet recording apparatus to which the present invention is applicable. FIGS. 8A, 8B and 8C are views that schematically illustrate step by step the wiping operation and the pseudo wiping operation of wiping means of the ink jet recording apparatus to which the present invention is applicable.

Figure 9:
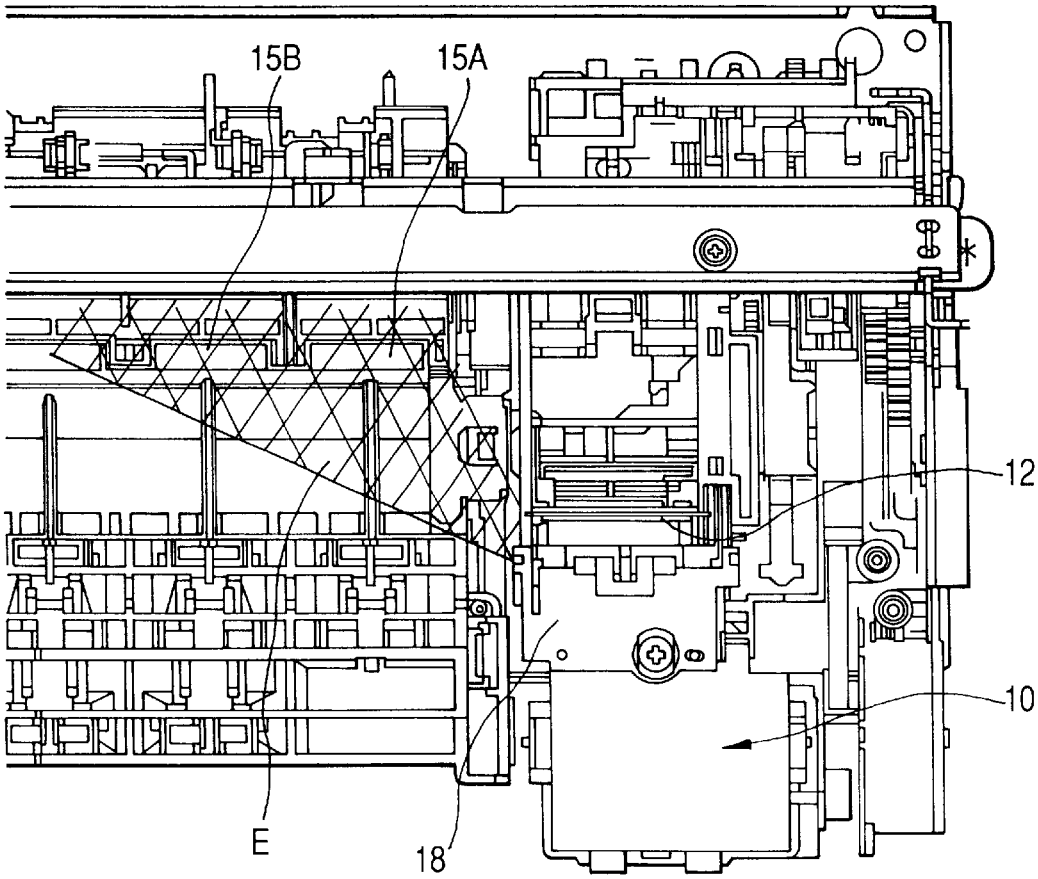
FIG. 9 is the schematically partial plan view that shows the example of the area of ink spreading from wiping means of an ink jet recording apparatus.
Figure 10:
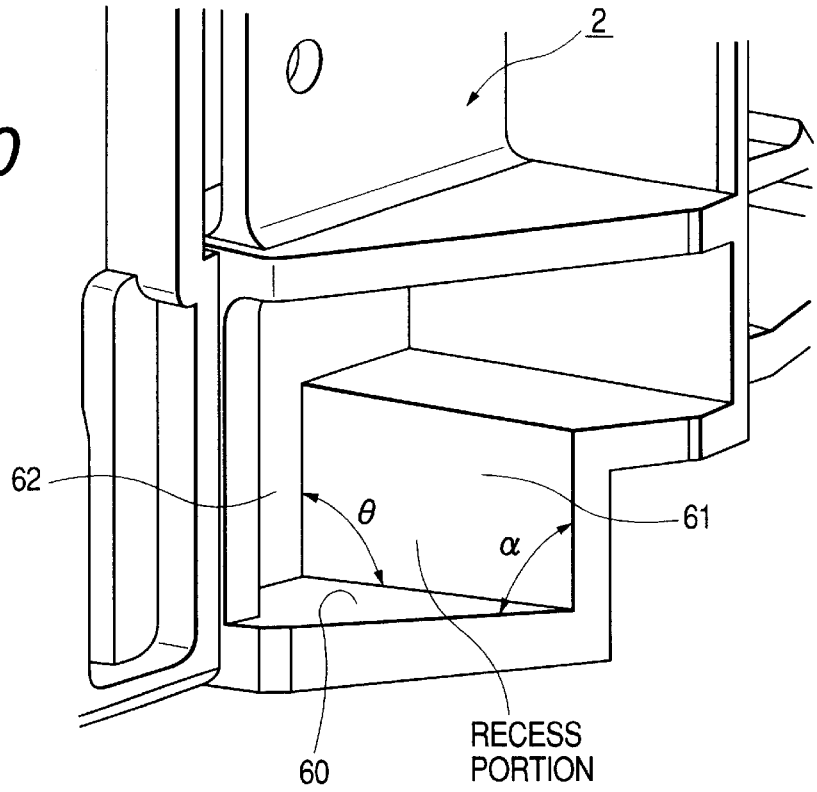
FIG. 10 is a perspective view that schematically shows the structure of a spread ink receptacle of a carriage of one embodiment of the ink jet recording apparatus to which the present invention is applicable.
Figure 12:
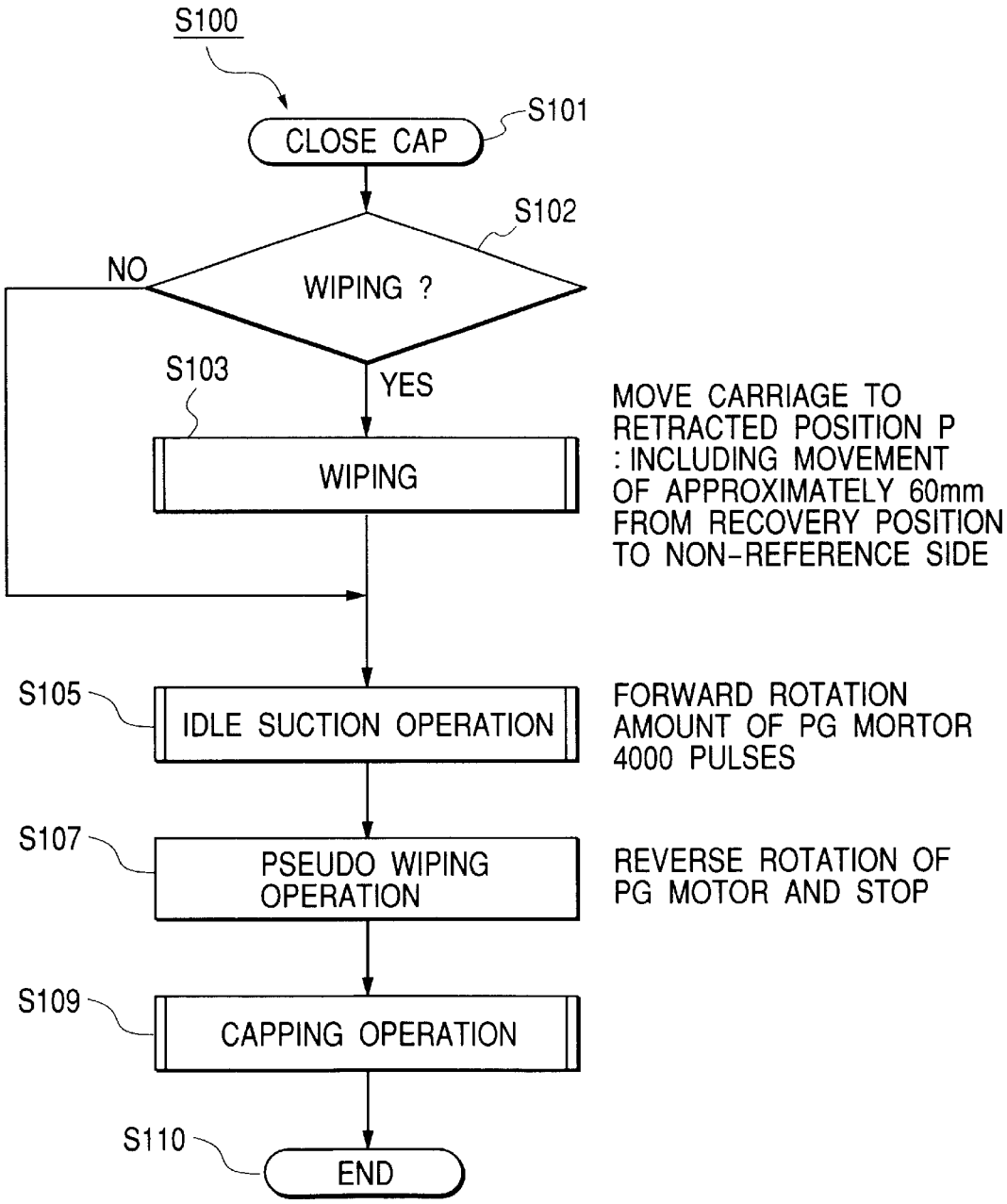
FIG. 12 is a flowchart that shows briefly the sequence of cap closing operation in accordance with one embodiment of the ink jet recording apparatus to which the present invention is applicable.
Figure 13:
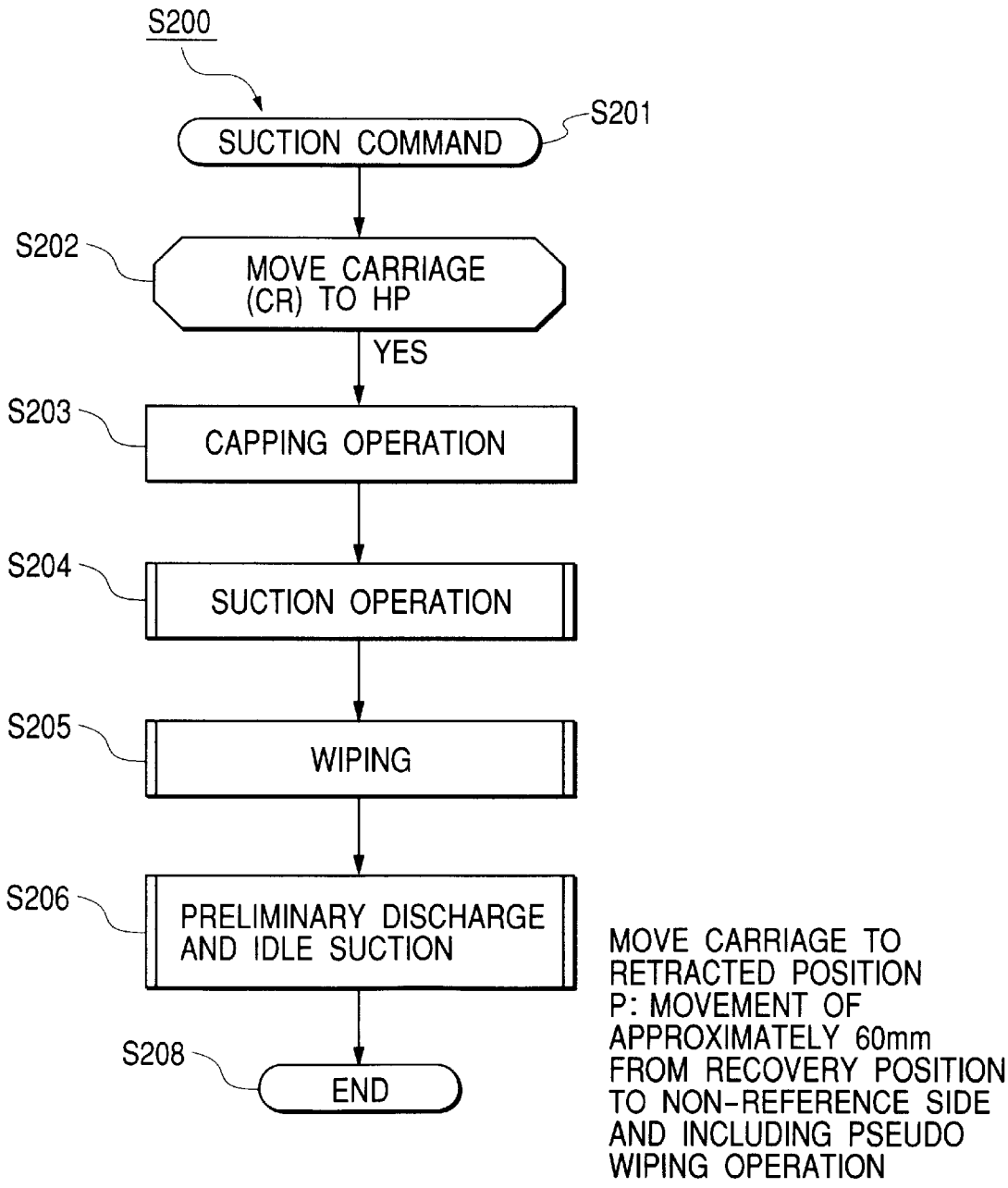
FIG. 13 is a flowchart that briefly shows the sequence of recovery suction operation in accordance with one embodiment of the ink jet recording apparatus to which the present invention is applicable.
Figure 14:
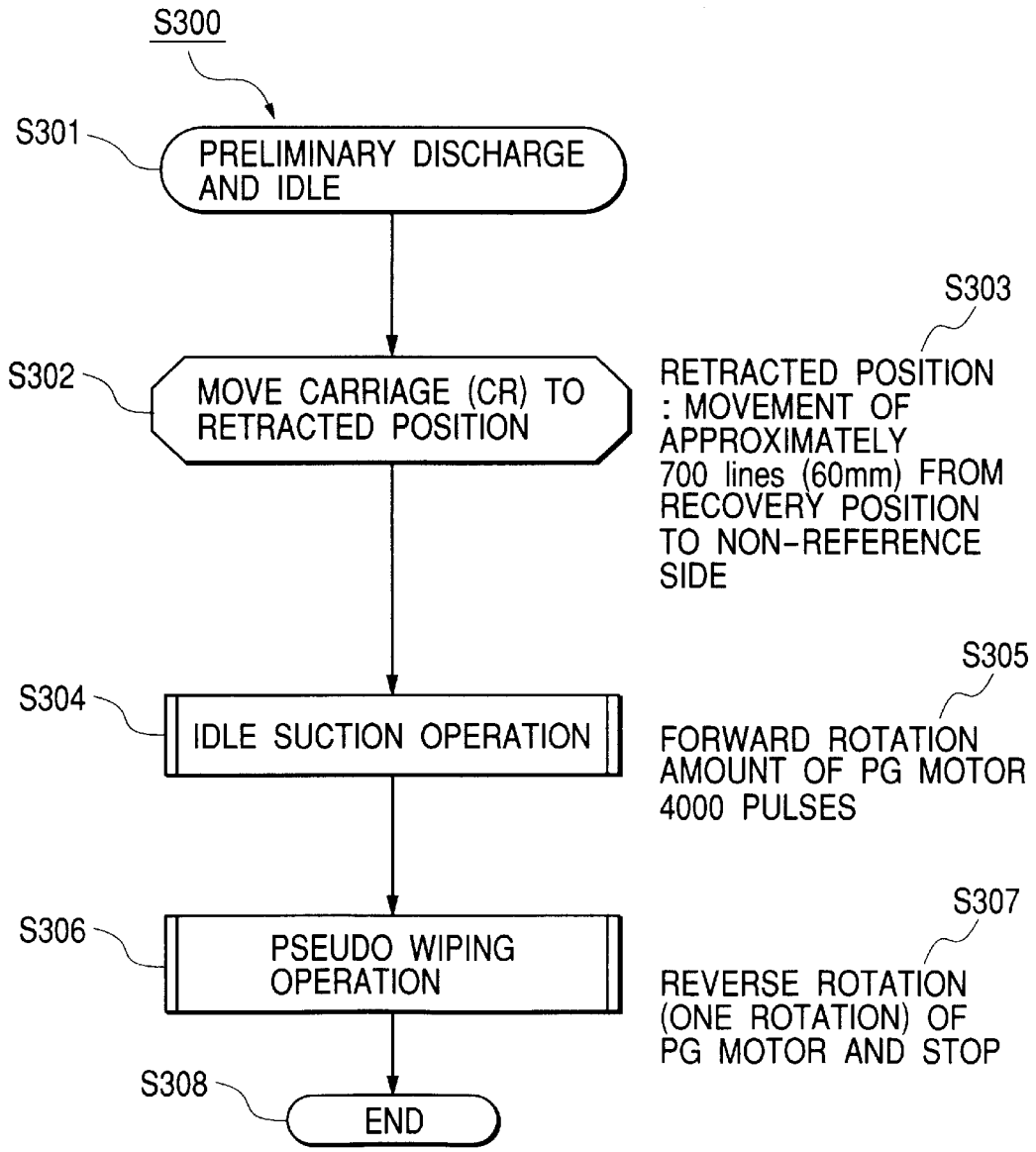
FIG. 14 is a flowchart that briefly shows the sequence of preliminary discharging idle suction operation during recording in accordance with one embodiment of the ink jet recording apparatus to which the present invention is applicable.
Figure 15:
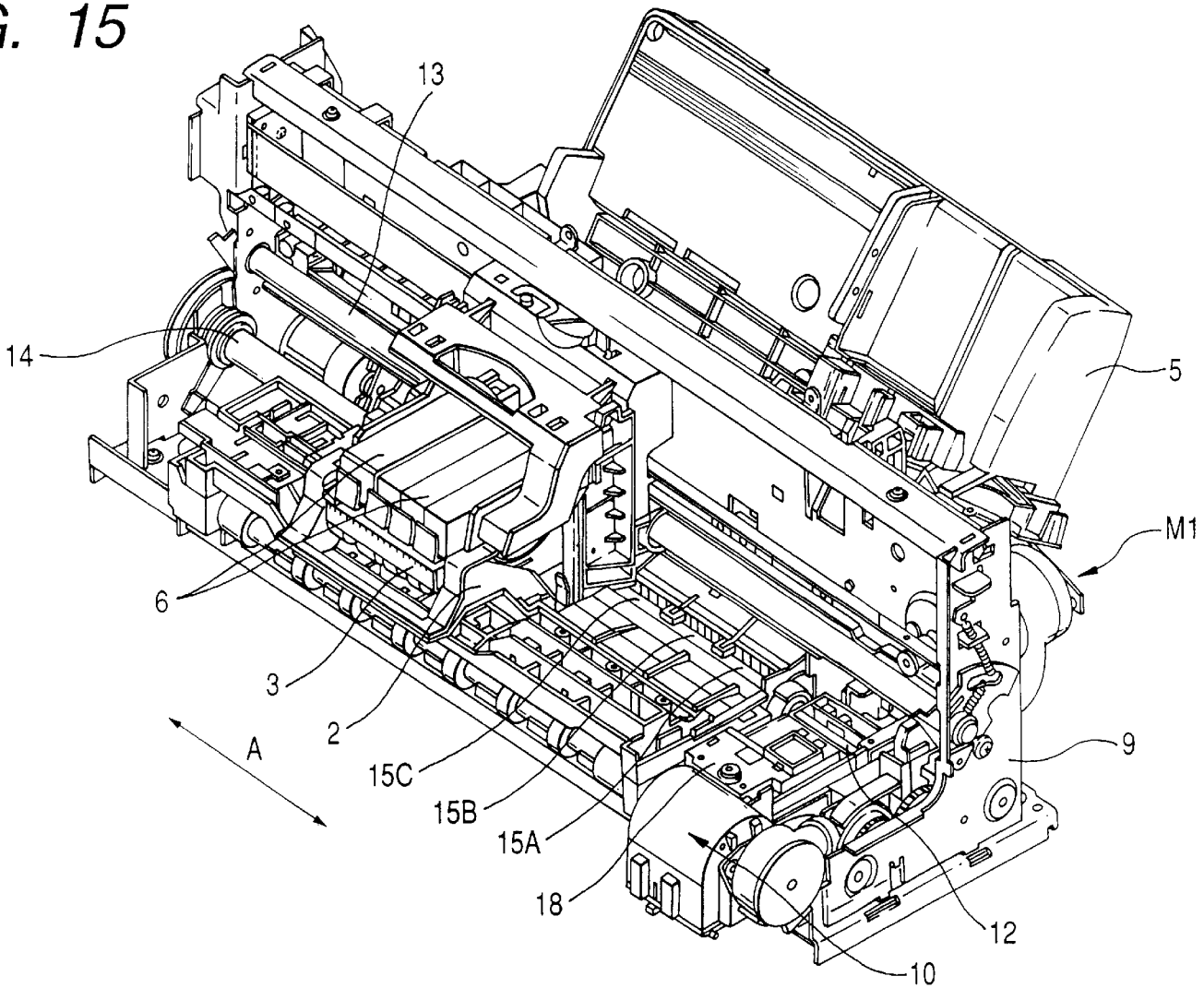
FIG. 15 is a perspective view that schematically shows the example of the carriage position of the conventional wiping operation and pseudo wiping operation of an ink jet recording apparatus.

Further, FIG. 9 is the schematically partial plan view that shows the example of the area of ink spreading from wiping means of an ink jet recording apparatus. FIG. 10 is a perspective view that schematically shows the structure of a spread ink receptacle of a carriage of one embodiment of the ink jet recording apparatus to which the present invention is applicable. FIG. 12 is a flowchart that shows briefly the sequence of cap closing operation in accordance with one embodiment of the ink jet recording apparatus to which the present invention is applicable. FIG. 13 is a flowchart that briefly shows the sequence of recovery suction operation in accordance with one embodiment of the ink jet recording apparatus to which the present invention is applicable. FIG. 14 is a flowchart that briefly shows the sequence of preliminary discharging idle suction operation during recording in accordance with one embodiment of the ink jet recording apparatus to which the present invention is applicable. FIG. 15 is a perspective view that schematically shows the example of the carriage position of the conventional wiping operation and pseudo wiping operation of an ink jet recording apparatus.

At first, with reference to FIG. 2 and FIG. 4, the description will be made of the structure of the recovery device (recovery unit) 10. The recovery device 10 comprises suction means 48, capping means 11, wiping means 12, and blade cleaning means 18, among some others, as means for recovering disabled discharge, defective discharge, or the like of the recording head 3 (as recovery means).

Here, a tube pump forms the aforesaid suction means 48. There are publications that disclose the structure and operation of the tube pump serving as suction means of the recovery device, such as Japanese Patent Application Laid-Open No. 2000-110874 (Japanese Patent Application No. 10-293116), Japanese Patent application Laid-Open No. 2000-127450 (Japanese Patent Application No. 10-321534), Japanese Patent Application Laid-Open No. 2000-15844 (Japanese Patent Application No. 10-199684), Japanese Patent Application Laid-Open No. 11-342637 (Japanese Patent Application No. 10-166334), and others. The tube pump (suction means) 48 is provided with the two suction tubes 32 arranged to follow the circular inner face of the recovery base 20 as the guide face therefore, and specific numbers (four in total for the present embodiment) of pressure rollers 33 (not shown) that generate negative pressure in the suction tubes 32 when depressed by the suction tubes 32 to roll while squeezing the suction tubes.

The pressure roller 33 is arranged to squeeze the suction tubes 32 when rolling along the suction tubes 32 in a state of being depressed by the suction tubes 32 by use of the pressure spring (not shown). Also, the pressure roller 33 is biased to the side where it presses the suction tubes 32 during the suction operation, and supported movably along the elongated groove formed for the pressure roller holder 31 so that it can retract from the suction tubes 32 during the operation other than the suction one. For the present embodiment, two pieces of such pressure roller 31 are arranged per each suction tube 32.

The pressure roller holder 31 that axially supports the pressure roller 33 is rotatively supported by a pressure roller holder guide 30 in the radial direction of the circular guide face of the recovery base 20, thus compressing to or retracting the pressure roller 33 from the suction tube 32. The pressure roller holder guide 30 is provided with shafts on both end portions, which is axially supported centering on the circle of the circular guide face of the recovery base 20 where the suction tubes 32 are arranged so as to be made rotative with the driving transmission from the driving motor (hereinafter referred to as a PG motor) M3.

Here, the transmission of the driving power from the PG motor M3 to suction means 48 is such as to transmit it to the PG gear 24 and pump gear 27 at first, and then, to the pump gear 27 which is axially supported to the rotational shaft of the pressure roller holder guide 30. Also, suction means 48 is in the form of directly connected with the rotational shaft of the PG motor M3, and it is structured so that with the rotation of one-direction (regular rotation) of the PG motor M3, the suction operation is performed, and with the rotation of the other direction (reversal rotation), the pressure roller moves in the direction to release it from the condition in which it compresses the suction tube 32.

Capping means 11 comprises the cap 35 that abuts against the discharge port surface 23 of the recording head 3; a cap absorbent (not shown) that absorbs efficiently ink exhausted from the discharge port 49 of the recording head 3 shown in FIG. 11; the cap holder 36 that supports the cap 35 by use of a cap spring (not shown), pressing the cap to be in contact with the discharge port surface 23 of the recording head 3; the cap base 34 that supports the cap spring (not shown) to provide capping pressure for the cap holder 36, and also, supports the cap holder slidably in the direction from the top to the bottom; and a lever 37 for handling capping means to rise and fall, which becomes an arm member that enables the cap 35 to abut against or retract from the discharge port surface 23 of the recording head 3.

To the joint portion arranged for the cap holder 36 of capping means 11, the suction tube 32 that constitutes suction means 48 is connected. Then, it is structured that during the period in which the cap 35 abuts against the discharge port surface 23 of the recording head 3 (in the capping status), negative pressure is exerted in the cap 35 with the suction operation of suction means 48 to suck (exhaust) ink from the discharge port 49 of the recording head 3. The rising and falling operation of capping means 11 to abut against the recording head 3 is such as to be driven by means of the driving power of the PG motor M3 transmitted through the PG gear 25, PG gear 26, and the like to the one way clutch gear 28 engaging with the cam 38, which executes the rising and falling operation of capping means 11. This one way clutch gear 28 functions to transmit the driving power of the PG motor M3 to the cam 38 when it rotates in one way, but to idle when it rotates in the other way so as not to transmit such driving power to the cam 38.

The cam 38 is also used for driving wiping means 12 and for controlling the rising and falling operation of the CR lock lever 29, besides it is used for the aforesaid capping means 11. The CR lock lever 29 is arranged to position the recording head 3 during the recording operation of the recording head 3 and the capping means 11 that forms the recovery unit 10 in accordance with the present embodiment. The rising and falling operation of this lever is also controlled by use of the aforesaid cam 38. Each operation of capping means 11, wiping means 12, and the like is executed by controlling each means with the performance of rotational positioning of the cam 38 by the combination of the cam position detecting sensor flag and the cam position detection sensor 40 provided for the cam 38.

As shown in FIG. 4, wiping means 12 comprises the wiper blade 41 that wipes off ink adhering to the discharge port surface 23 of the recording head 3; the blade holder 42 that holds the wiper blade for the reciprocation thereof (to move it forward and backward); the blade lever gear 44 that engages with the rack of the blade holder to transmit driving power to the blade holder; and the blade lever 43 that transmits the reciprocation driving power to the wiper blade 41. The blade lever 43 axially supports the blade lever gear 44, while moving linearly by pressing the end portion with the rotational motion of the aforesaid cam 38. The blade lever 43 axially supports the blade lever gear 44 that directly connects the PG base rack 45 and the blade holder rack (not shown), and functions to convert the rotational driving of the cam 38 transmitted from the PG motor M3 to the linearly reciprocation of the blade holder 42.

In accordance with the present embodiment, wiping means 12 is structured as described above to operate so that the recording head 3 moves in the direction (indicated by an arrow A) in which the wiper blade 41 is allowed to enter at the time of wiping, and passes the blade cleaner 47 provided for blade cleaning means 18 to scrape off ink adhering to the wiper blade 41 and receives the rotational movement of the aforesaid cam 38, and then, to shift the movement so as to enable the wiper blade to move in the retracting direction (indicated by an arrow B), thus returning to the original position by receiving spring force (not shown) after passing through the blade cleaner 47.

Also, the blade cleaner 47 and the blade cleaner holder 46, which constitute blade cleaning means 18, move in the direction (indicated by the arrow E) in which the wiper blade 41 is allowed to enter, and the aforesaid blade cleaner holder 46 is made stationary at an interfering position to scrape off ink adhering to the wiper blade 41 when the wiper blade enters the blade cleaner 47. In this manner, the scraping action is made more favorable, while making it possible to displace the wiper blade 41 so as to move into the retracting direction (the direction indicated by the arrow B) when the wiper blade 41 moves out from the blade cleaner 47. The structure is thus arranged to suppress ink spreading as much as possible. In other words, the structure is arranged so that the blade cleaner holder 46 axially supports the blade cleaner 47 to make its retraction possible centering on the rotationally supporting axis when the wiper blade 41 moves out from the blade cleaner 47.

For the aforesaid recovery device 10, one motor operates plural recovery operations. The structure is, therefore, arranged to perform the same operation as the one described earlier for the recovery operations other than wiping the recording head 3. The ink jet recording apparatus of the present embodiment comprises recording means 3 having discharge port array for discharging ink; a carriage 2 having recording means 3 mounted thereon to reciprocate; wiping means 12 having the wiper blade 41 to reciprocate for removing stains of the discharge port surface 23 by ink discharged from the discharge ports 49; and blade cleaning means 18 having the blade cleaner 47 that scrapes off foreign substance, ink and other particles adhering to the wiper blade 41 of wiping means. In addition, there are the characteristic structures involved as described below.

Now, therefore, with reference to FIG. 4 to FIG. 7, FIGS. 8A to 8C and FIG. 9 to FIG. 14, the description will be made of the plural operations of the recovery device of the ink jet recording apparatus embodying the present invention. When the ink jet recording apparatus embodying the present invention performs the suction operation by use of the recovery device 10 of the recording head 3, the suction recovery is performed in accordance with the sequence of the flowchart shown in FIG. 13. The flowchart shown in FIG. 13 represents the general suction operation S200 by use of the recovery device (recovery unit) 10 of the present embodiment. Hereunder, with reference to FIG. 13, the description will be made of the suction recovery operation in accordance with the present embodiment.

In FIG. 13, when a suction command is issued (step S201), the cam position detection sensor 40 detects the position of the cam 38 that constitutes the recovery device 10 to confirm the positions of capping means 11, wiping means 12, and others. If the recording head 3 is found not to be positioned for suction recovery operation, the transmission mechanism 4 shown in FIG. 1 is driven to move the recording head 3 (the CR2 that mounts the recording head) to the position where suction recovery operation is executed (the home position HP, for example) after the cam position detection sensor 40 has confirmed that the recording head 3 is not in a state of interfering with the capping means 11, wiping means 12, and others that constitute the recovery device 10 (step S202). After that, for the execution of the suction recovery operation, the PG motor M3 drives the cam 38 to rotate the cam 38, thus enabling capping means 11 to abut against the discharge port surface 23 of the recording head 3 (the capping operation in the step S203).

Next, the PG motor M3 rotates in the direction of suction operation, that is, the direction in which the driving power is given to suction means 48 side for the execution of the suction recovery operation to suck a designated amount of ink (step S204). The suction operation (the step S204) is completed, and then, after capping means 11 retracts from the recording head 3, the PG motor M3 is driven to execute the wiping operation (step S205). Here, the reason why the wiping operation is executed is that usually excessive ink adheres to the discharge port surface 23 of the recording head 3 after a suction operation.

Here, with reference to FIGS. 8A to 8C, the description will be made of the wiping operation and blade cleaning operation in the step S205. In FIGS. 8A to 8C, the wiper blade 41 moves in the sheet expelling direction intersecting with (orthogonal to) the carriage scanning direction (direction indicated by an arrow A) in order to wipe off ink adhering to the recording head 3 in the wiping operation in the step S205, and after cleaning the discharge port surface 23 of the recording head 3, the wiper blade 41 enters the blade cleaner 47 to scrape off ink transferred thereto by use of the blade cleaner 47. After that, by driving the PG motor M3, the direction of the wiper blade 41 movement is reversed to shift the wiper blade in the retracting direction of wiping means (direction indicated by an arrow B). When the wiper blade 41 returns to the original position, the wiping operation terminates.

In this case, the carriage 2 that mounts the recording head 3 moves in advance to the carriage retracting position and stops at that position until the wiper blade 41 returns to the original position in order to avoid any unnecessary contact with the wiper blade 41 that wipes the discharge port surface 23. The carriage retracting position is arranged near the recovery device 10 as shown in FIG. 6 and FIG. 7, and set at a reference mark L (approximately 60 mm to non-reference side, for example) from the suction recovery position (above the head of the recovery device 10). This position is near the referential position side of the sheet conveyance area, which is above the vicinity of the first pinch roller 15A, the second pinch roller 15B, and the third pinch roller 15C counted from the referential side. Therefore, it is required to prevent (block) anything that may cause the contamination, such as ink spread, in particular, from entering this region.

Here, in accordance with the present embodiment, the carriage retracting position is arranged to be in the position where the carriage 2 (side face portion of the carriage 2 in particular) can cover the ink spreading region E (the position of the aforesaid first and second pinch rollers 15A and 15B) in the sheet conveyance area as shown in FIG. 9, hence making it possible to block (prevent) ink spread from entering this area by the side face portion of the carriage 2. In other words, the moment the wiper blade 41 retracts from the blade cleaner 47 is such that ink spread may be accompanied due to the resilient restoring force of the wiper blade. However, the carriage retracting position is arranged to block any possible ink spread at that moment by the side face portion of the carriage 2, and set to prevent ink spread from entering the sheet conveyance area. Further, in accordance with the present embodiment, when the wiping operation is performed to wipe the discharge port surface 23, the carriage 2 moves to the carriage retracting position in order to avoid any contact with the wiper blade 41, thus making it possible to obtain the same functional effect as described earlier.

Such as this, after the completion of the wiping operation, the recording head 3 moves to the suction recovery position where it performs preliminary discharge of the ink of mixed colors that may have entered the discharge ports 49 of the recording head 3 at the time of suction operation and wiping operation. In accordance with the present embodiment, this preliminary discharge is performed in the suction recovery position in such a manner that ink is discharged from the discharge ports 49 to the inside of the cap 35. After the completion of the preliminary discharge, the waste ink retained in the cap 35 is exhausted. This ink exhaustion is conducted in such a manner that the PG motor M3 is driven to rotate suction means 48 in the direction of suction recovery operation, and exhaust the waste ink in the cap to the outside of the recovery device 10 through the suction tube 32 connected with the cap 35. With the execution of such preliminary idle discharge suction operation (the step S206 in FIG. 13), the general suction recovery operation (step S200 in FIG. 13) terminates (step S208).

At this juncture, suction means (suction pump) 48 is released in a state of the pressure roller 33 being rolled on the suction tube 32 under pressure, the PG motor M3 is driven to rotate the pressure roller 33 in the releasing direction thereof, and operate to enable the pressure roller 33 to part from the suction tube 32 step S307 in FIG. 14). The recovery device of the present embodiment performs plural recovery operations with one driving source. Therefore, the structure is arranged so that interlocked with the aforesaid operation, the recovery device is allowed to enter pseudo wiping operation (step S307 in FIG. 14).

For the conventional ink jet recording apparatus, no structure is adopted so as to position the carriage 2 in a specific position when the pseudo wiping operation is performed as described earlier. As shown in FIG. 15, therefore, it is required to set timing for the carriage 2 to enter the pseudo operation in a state of being in indefinite position, and there is a possibility that ink spreads due to resilient restoring force of the wiper blade 41 (bending) at the time of pseudo wiping operation and stains the sheet conveyance area. In contrast, in accordance with the ink jet recording apparatus to which the present invention is applicable, when the recovery operation that generates the pseudo wiping operation, the carriage 2 is always stationary at P in the carriage retracting position to prevent ink spread to the sheet conveyance area due to the bending of the wiper blade 41 (resilient restoring force) when the wiper blade 41 moves out from the blade cleaner 47. In this way, recording is possible without staining recording material, such as a recording sheet being conveyed.

For the ink jet recording apparatus of the present embodiment, there are a cap closing operation shown in FIG. 12 (S100) and a preliminary discharge idle suction operation during recording shown in FIG. 14 (S300), besides the aforesaid suction recovery operation and others. Also, for the cap closing operation (S100) and the preliminary discharge idle suction operation during recording (S300), the sequence that includes the aforesaid pseudo wiping operation is incorporated.

Next, with reference to FIG. 12, the description will be made of the cap closing operation. In FIG. 12, when a cap closing command is issued (step S101), the CPU (not shown) determines whether or not the wiping operation is executed (step S103) depending on the conditions of the discharge port surface 23 of the recording head 3. The wiping operation is executed as required (the step S103). After that, an idle suction operation is executed (step S105) in order to exhaust from the cap 35 the ink that retained in the cap 35 due to the preliminary discharge and others during recording. At this juncture, the same operation as the preliminary discharge idle suction operation is performed.

In other words, in order to release the pressure roller 33 from the state of pressurized contact with the suction tube 32 that constitutes suction means 48, not only the pressure releasing operation of the pressure roller 33 is performed by use of the PG motor M3, but also, interlocked with this operation, the pseudo wiping operation is executed (step S107). Then, in this operation, the carriage 2 moves to the carriage retracting position P before the pseudo wiping operation is performed, which resides at the carriage retracting position P until the pseudo wiping operation is completed. After that, the capping operation (step S109) is performed to enable the cap 35 to abut against the recording head 3 mounted on the carriage 2. Thus, a series of cap closing operation terminates (step S110).

Next, with reference to FIG. 14, the description will be made of the preliminary discharge idle suction operation during recording (S300). In FIG. 14, when the command of a preliminary discharge idle suction during recording is issued (step S301), the carriage 2 moves to the carriage retracting position P (step S302). After that, the idle suction operation is executed (step S304) to exhaust ink (waste ink) retained in the cap 35 due to the preliminary discharge during recording. In the same manner as the aforesaid suction recovery operation (at S200 in FIG. 12) and the cap closing operation (at S100 in FIG. 12), the PG motor M3 is driven to release the pressure roller 33 subsequent to the idle suction operation (the step S304), hence enabling the pressure roller 33 to part from the suction tube 32 that constitutes suction means to be in the state of being released from the pressurized contact (step S306). At this juncture, interlocked with the pressure releasing operation of the pressure roller 33 (the step S306), the pseudo wiping operation is executed (step S307). Then, after the cap 35 returns to the same position immediately before entering the preliminary discharge idle suction operation during recording (S300), the sequence of the preliminary discharge idle suction operation during recording (S300) terminates.

In accordance with the present embodiment, with the carriage 2 being at the carriage retracting position P when the pseudo wiping operation (step S307) takes plate in the preliminary discharge idle suction operation during recording (S300), it becomes possible to prevent ink spread to the sheet conveyance area due to bending (resilient restoring force) of the wiper blade 41 at the time of the wiper blade 41 moving out from the blade cleaner 47 in the aforesaid pseudo wiping operation. Recording is possible on a recording sheet without the recording sheet being conveyed.

Next, with reference to FIG. 10, the description will be made of the configuration of the side face portion of the carriage 2 of the present embodiment. In FIG. 10, the side face portion of the carriage 2 is the one that receives spreading ink during the period when the carriage resides in the carriage retracting position P in order not to allow spread ink to enter the sheet conveyance area during the blade cleaning operation and the pseudo wiping operation. Also, on the side face of the carriage 2, a recessed portion is formed to prevent the received ink (spread ink) from dropping off to the sheet conveyance area (the area where the recording material is conveyed) during the recording operation of the carriage 2. In other words, the recessed portion is formed so as not to stain the recording sheet (recording material) being conveyed with the ink received by the carriage 2 (ink retained in the recessed portion) that may drop off.

Here, as shown in FIG. 10, the bottom face 60 of the recessed receiving portion of the carriage 2 is inclined to make an angle formed by the receiving bottom face and the receiving front wall 61 to be an acute angle $\alpha$ to the horizontal plane, while being inclined to make the angle $\theta$ formed by the receiving bottom face and the receiving side wall 62 to be an acute angle. With the inclination thus made for the receiving bottom face 60 to form acute angle to each of the walls 61 and 62, respectively, it becomes possible to retain the spread ink received by the aforesaid bottom face 60 deep in this portion, hence preventing ink residing on the receiving bottom face 60 from dropping off to the recording sheet conveyance area while the carriage 2 moves for recording. As described above, the present embodiment prevents any stain that may be made on the recording sheet conveyance area (the area where the recording sheet is conveyed) due to ink spread, hence making recording possible on a recording material (recording sheet) without staining it.

In other words, in accordance with the embodiment described above, the ink jet recording apparatus is provided with recording means 3 having discharge ports 49 for discharging ink; the carriage 2 that moves with recording means mounted thereon; wiping means 12 having the wiper blade 41 that wipes and cleans the discharge port surface 23 of recording means; and blade cleaning means 18 having the blade cleaner that wipes off ink adhering to the wiper blade of wiping means. For this ink jet recording apparatus, the structure is arranges so that the ink that spreads when the wiper blade 41 of wiping means 12 moves out from the blade cleaner 47 of blade cleaning means 18 is prevented by the side face portion of the carriage 2 from spreading over to the recording material conveyance area. Therefore, when the wiper blade 41 moves out from the blade cleaner 47, the ink that has adhered thereto is not allowed to spread to the recording material conveyance area due to the restoring force of the wiper blade. In this way, it becomes possible to provide an ink jet recording apparatus capable of preventing spread ink from staining a recording material.

Further, in accordance with the embodiment described above, the carriage 2 is structured to reside in the position above the recording material conveyance area near wiping means 12 and blade cleaning means 18 when the wiper blade 41 moves out from the blade cleaner 47, and also, structured to provide a recessed portion (the recessed portion having the receiving bottom face 60, the receiving front wall 61, and the receiving side wall 62) for the side face portion of the carriage 2 to receive spread ink when the wiper blade 41 moves out from the blade cleaner 47, or structured to provide inclined portions (inclines faces of the receiving bottom face 60) for the bottom face of the recessed portion of side face of the carriage 2 in order to prevent ink in the recessed portion from dropping off to the recording material conveyance area. As a result, it becomes more efficient to eliminate spreading the ink that has adhered to the wiper blade to the recording material conveyance area due to the resilient restoration thereof when the wiper blade 41 moves out from the blade cleaner 47, and provide an ink jet recording apparatus capable of preventing spread ink from staining a recording material.

Here, for the embodiment described above, the description has been made exemplifying the ink jet recording apparatus of the serial recording type that records by relatively moving recording means to a recording material, but the present invention is equally applicable to the ink jet apparatus of the line recording type in which recording is made by only sub-scanning with recording means of line type covering the length equivalent to the entire width of a recording material or a part thereof, and the same effect is attainable. Also, the present invention is equally applicable to the recording apparatus that uses one recording means, the color recording apparatus that uses plural recording means for recording in ink of different colors, or the graduation recording apparatus that uses plural recording means for recording in the same color but in different densities, and the same effect is attainable. Further, the present invention is equally applicable to the case where these recording apparatuses are combined, and the same effect is attainable.

Furthermore, the present invention is equally applicable to any other case of the structural arrangement of a recording head and an ink tank, such as a structure using the ink cartridge integrally formed with a recording head and an ink tank, which are formed exchangeably, a structure using a recording head and an ink tank as separate members, which are connected with an ink supply tube or the like, and the same effect is attainable. In this respect, the present invention is applicable to an ink jet recording apparatus even when it uses recording means of electromechanical converting element, such as piezoelectric element. Particularly, however, it demonstrates exceptionally excellent effect when applied to an ink jet recording apparatus that uses recording means of ink discharge type utilizing thermal energy, because with such method, the performance of is attainable in higher density and higher precision.

What is claimed is:

1. An ink jet recording apparatus comprising:

a carriage having mounted thereon recording means provided with discharge port surface with discharge ports for discharging ink to a recording material;

a wiper blade for wiping and cleaning said discharge port surface of said recording means; and a blade cleaner for wiping off ink adhering to said wiper blade, wherein when said carriage is moved to a carriage retracting position, the side face portion of said carriage blocks or reduces the spreading of ink to the recording material conveyance area before said wiper blade moves out from said blade cleaner.

2. An ink jet recording apparatus according to claim 1, wherein said carriage retracting position is a position above the recording material conveyance area near said wiper blade and said blade cleaner.

3. An ink jet recording apparatus according to claim 1, wherein a recessed portion is provided for the side face portion of said carriage to receive ink spreading when said wiper blade moves out from said blade cleaner.

4. An ink jet recording apparatus according to claim 3, wherein an inclined portion is provided for a bottom face of said recessed portion of the side face portion of said carriage to prevent ink in said recessed portion from dropping off to the recording material conveyance area.

5. An ink jet recording apparatus according to claim 1, wherein said recording means is ink jet recording means provided with electrothermal converting element for generating thermal energy to be utilized for discharging ink.

6. An ink jet recording apparatus according to claim 5, wherein said recording means discharges ink form discharge ports utilizing film boiling in ink generated by thermal energy generated by said electrothermal converting element.

7. A method of operation for an ink jet recording apparatus provided with a carriage having mounted thereon recording means with discharge port surface having discharge ports for discharging ink to a recording material; a wiper blade for wiping and cleaning said discharge port surface of said recording means; and a blade cleaner for wiping off ink adhering to said wiper blade, comprising the following steps of:

wiping off ink adhering to said wiper blade by said blade cleaner; and enabling said carriage to reside in a position above the recording material conveyance area near said wiper blade and said blade cleaner before said wiper blade moves out from said blade cleaner.

8. An ink jet recording apparatus comprising:

a carriage having mounted thereon recording means provided with a discharge port surface with discharge ports for discharging ink to a recording material;

a wiper blade for wiping and cleaning said discharge port surface of said recording means; and a blade cleaner for wiping off ink adhering to said wiper blade, wherein said carriage is moved to a carriage retracting position above the recording material conveyance area near said wiper blade and said blade cleaner before said wiper blade moves out from said blade cleaner.

9. A method of operation for an ink jet recording apparatus provided with a carriage having mounted thereon recording means with a discharge port surface having discharge ports for discharging ink to a recording material; a wiper blade for wiping and cleaning said discharge port surface of said recording means; and a blade cleaner for wiping off ink adhering to said wiper blade, comprising the following steps of:

wiping off ink adhering to said wiper blade by said blade cleaner; and enabling said carriage to reside in a carriage retracting position above the recording material conveyance area near said wiper blade and said blade cleaner before said wiper blade moves out from said blade cleaner.

* * * * *